US011873066B1

(12) United States Patent
Oboroc et al.

(10) Patent No.: US 11,873,066 B1
(45) Date of Patent: Jan. 16, 2024

(54) PORTABLE MARINE ANCHORING DEVICE AND PORTABLE FENDER

(71) Applicants: Radu Oboroc, Bradenton, FL (US); Andrew Vishnevsky, Sarasota, FL (US); Natalia Oboroc, Sarasota, FL (US); Victor Vishnevsky, Sarasota, FL (US)

(72) Inventors: Radu Oboroc, Bradenton, FL (US); Andrew Vishnevsky, Sarasota, FL (US); Natalia Oboroc, Sarasota, FL (US); Victor Vishnevsky, Sarasota, FL (US)

( * ) Notice: Subject to any disclaimer, the term of this patent is extended or adjusted under 35 U.S.C. 154(b) by 0 days.

(21) Appl. No.: 18/242,891

(22) Filed: Sep. 6, 2023

Related U.S. Application Data

(60) Provisional application No. 63/497,815, filed on Apr. 24, 2023.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02; B63B 59/04
USPC ..... 114/219
See application file for complete search history.

(56) References Cited

U.S. PATENT DOCUMENTS 2,577,236 A * 12/1951 Doherty ..... E02B 3/26 114/219
4,843,994 A * 7/1989 Wilson ..... B63B 59/02 114/219
4,915,662 A * 4/1990 Kent ..... B63B 59/02 114/219
5,355,822 A * 10/1994 Lemke ..... B63B 59/02 114/219
5,732,645 A * 3/1998 Lemke ..... B63B 59/02 114/219
6,863,011 B2 * 3/2005 Kinkead ..... B63B 59/02 114/219

* cited by examiner

*Primary Examiner* — Lars A Olson
(74) *Attorney, Agent, or Firm* — Stanton IP Law Firm, P.A.; Thoams H. Stanton

(57) ABSTRACT

A portable marine anchoring device maximizes holding capacity while anchored into the bottom of a body of water and a portable and foldable fender capable of being securely fastened to a vessel to prevent it from being dislodged over time.

7 Claims, 17 Drawing Sheets

PORTABLE MARINE ANCHORING DEVICE AND PORTABLE FENDER

CROSS-REFERENCE TO RELATED APPLICATIONS

This application claims the benefit of U.S. Provisional Patent Application No. 63/497,815, filed on Apr. 24, 2023, which is incorporated by reference herein in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

TRADEMARK STATEMENT

Trademarks used in the disclosure of the invention and the applicants make no claim to any trademarks referenced.

BACKGROUND OF THE INVENTION

1) Field of the Invention

The present invention relates generally to a portable marine anchoring device and portable fender used by small craft.

2) Description of Related Art

The prior art describes numerous inventions which describe methods of anchoring a boat. The majority of the prior art describes the traditional way of anchoring a boat which is to drop a single anchor from the bow and drift or power the boat backwards. In this position the boat can swing side-to-side depending on wind and wave conditions. In some cases, the anchor can be dropped from the stern and the boat powered forward. The current prior art includes various anchors such as a box anchor, Mushroom Anchor, Plow Anchor, Claw Anchor, Grapnel Anchor, fluke anchor and Danforth. The current anchors all have a similar problem in that they can become lodged in the materials that make up the bottom of the body of water and these anchors are therefore difficult to retrieve.

The current state of the art for boat fenders are usually plastic tubes or bladders that are inflated and function as cushions to prevent the vessel or boat from contacting a dock or piling. Fenders are typically the best and easiest way to protect a vessel or boat from damage. Also known as boat bumpers, fenders work as cushions by absorbing the impact of bumps against docks, pilings, and other vessels, thus avoiding damage to your watercraft, and making sure that your boat's hull does not become damaged. However, these traditional fenders do not work well for small vessels such as a jet ski or wave runner because these vessels do not have the free board necessary to provide the opposing reaction to maintain the fender in position so that the fender can provide a cushion to protect the vessel.

Therefore, there is a need for an anchor that is light weight, does not create a tripping hazard and is designed to hold in sand.

SUMMARY IF THE INVENTION

With respect to the instant invention and specifically as it relates to the anchoring device as disclosed herein the anchoring device is a portable, lightweight anchor; and configured to anchor a vessel and have enhanced holding capacity, while tethered to a marine vehicle. The anchoring device also provides a simple way of freeing the anchoring device when the device becomes lodged in the bottom of the body of water.

The portable marine fender of the instant invention is a light weight and foldable fender designed to protect a vessel when docked from chafing against a dock or piling. The portable marine fender is foldable and provides a gripping mechanism to ensure that the portable marine fender is held in place on the vessel so that it protects the vessel from damage.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

The invention will now be described, by way of example, with reference to the accompanying drawings, in which.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
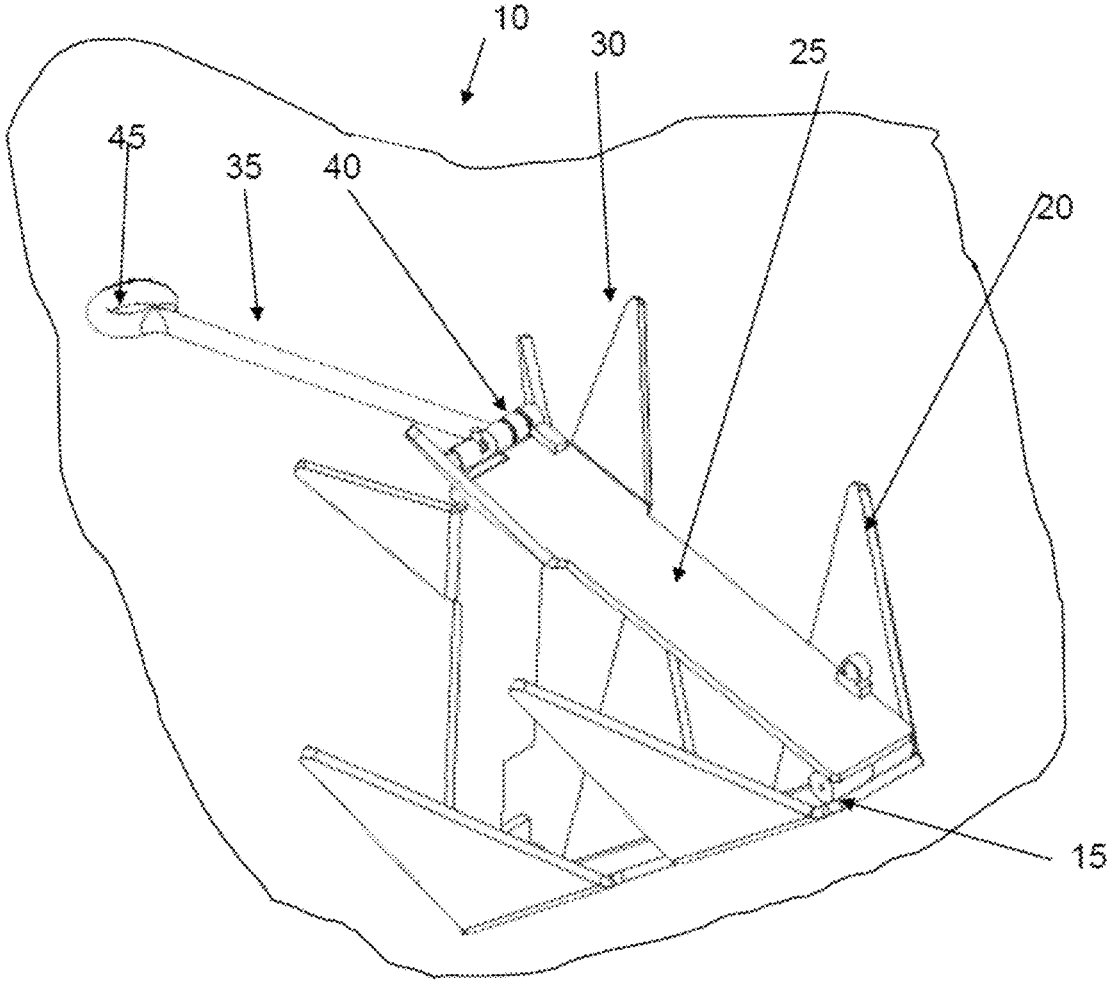
FIG. 1 illustrates a perspective view of the anchoring device of the instant invention.
Figure 2:
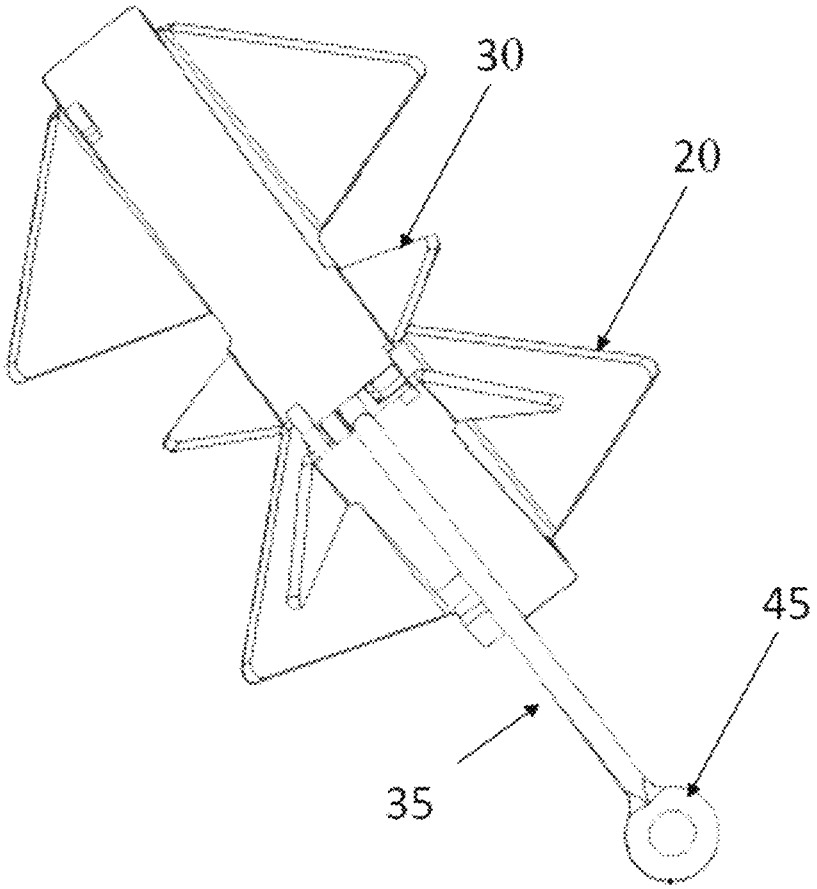
FIG. 2 is a top view of the anchoring device of the instant invention.
Figure 3:
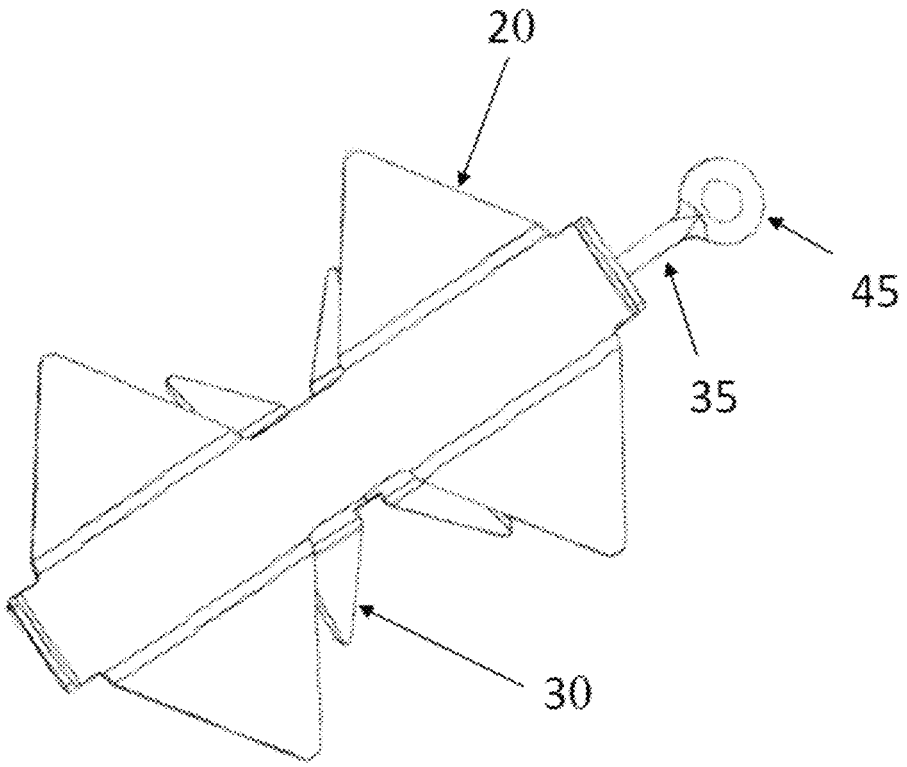
FIG. 3 is a bottom view of the anchoring device of the instant invention.
Figure 4:
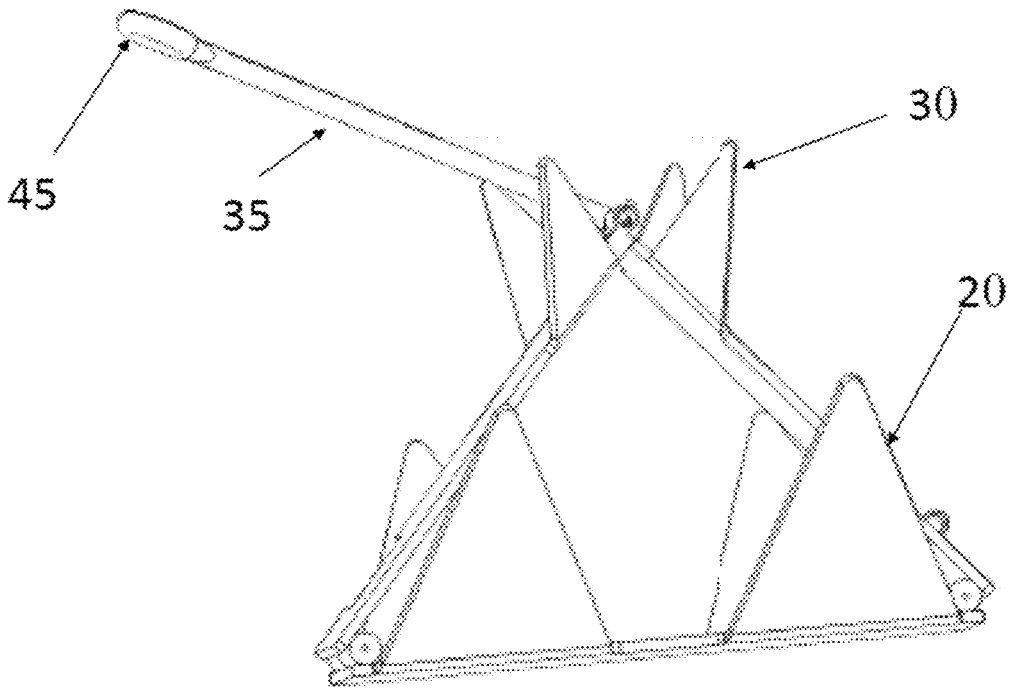
FIG. 4 is a right-side view of the anchoring device of the instant invention.
Figure 5:
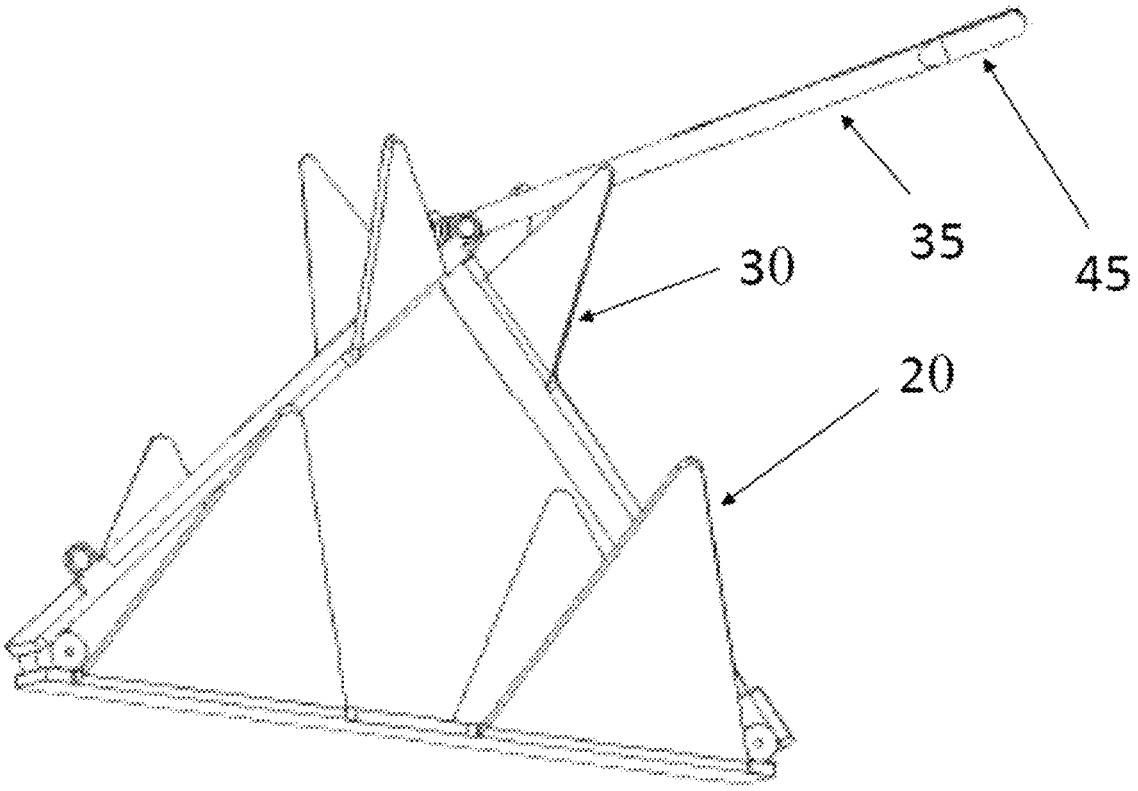
FIG. 5 is a left-side view of the anchoring device of the instant invention.
Figure 6:
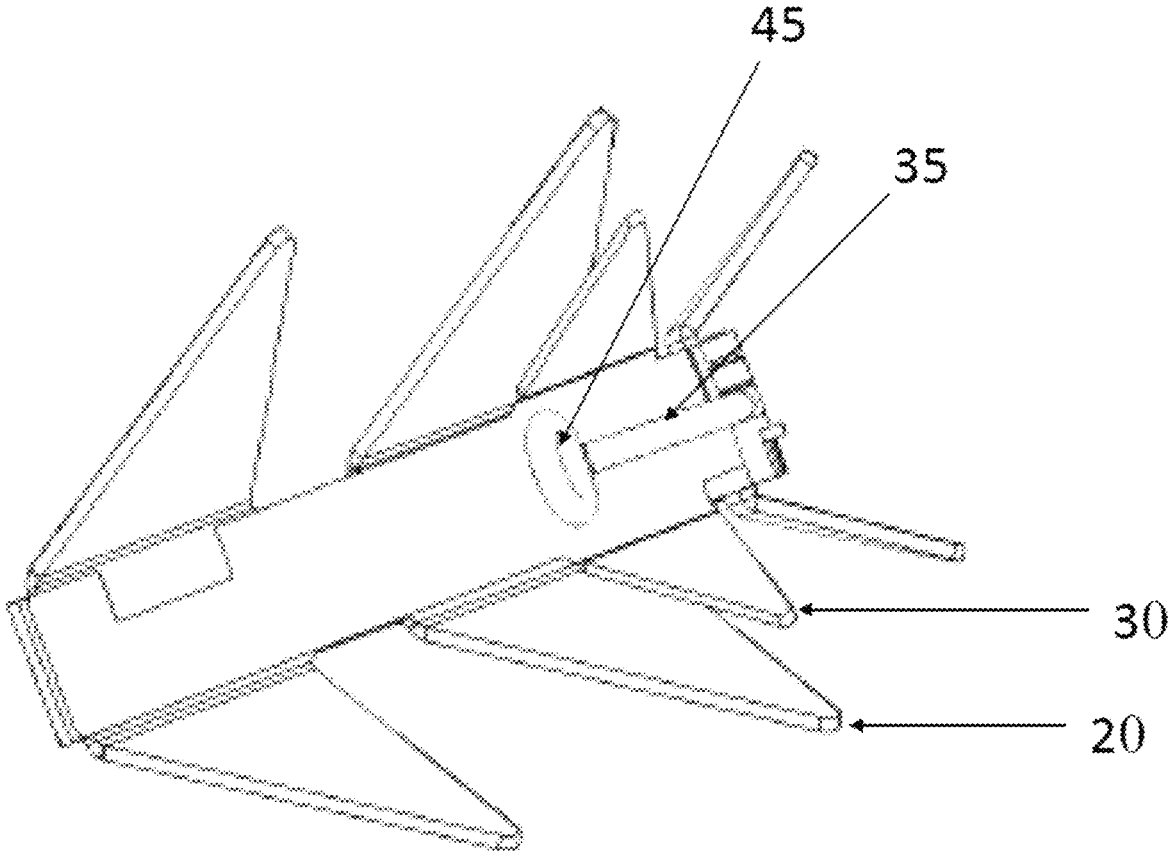
FIG. 6 is a front view of the anchoring device of the instant invention.
Figure 7:
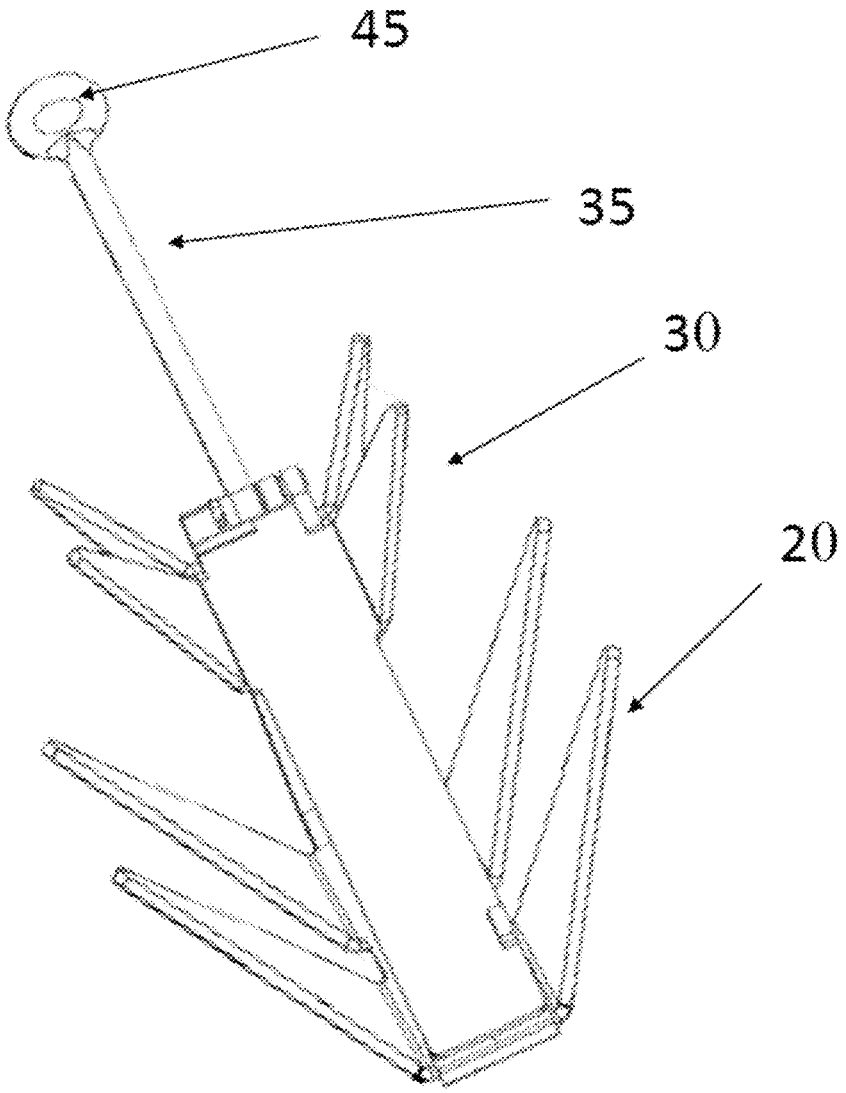
FIG. 7 is a back view of the anchoring device of the instant invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art however that other embodiments of the present invention may be practiced without some of these specific details. Several embodiments are described herein, and while various features are ascribed to different embodiments, it should be appreciated that the features described with respect to one embodiment may be incorporated with other embodiments as well. For the same reason, no single feature or features of any described embodiment should be considered essential to every embodiment of the invention, as other embodiments of the invention may omit such features.

In this application the use of the singular includes the plural unless specifically stated otherwise and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components including one unit and elements and components that include more than one unit, unless specifically stated otherwise.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps, or acts are in some way inherently mutually exclusive.

As this invention is susceptible to embodiments of many different forms, it is intended that the present disclosure be considered as an example of the principles of the invention and not intended to limit the invention to the specific embodiments shown and described.

The terms people, boater, consumer, and individual are used interchangeably to mean an individual who uses the invention.

The term watercraft, boat and marine vehicle as used within the specification of the invention is intended to mean any vessel and including and not limited to a Personal Watercraft (PWC), power boat, wave runner, jet ski or sailboat.

The term piling, dock and mooring device are used interchangeably in the specification to mean a structure that a vessel is moored to.

The term fender, cushion and bumper are used interchangeably and as used in the specification is meant to mean a protection device used between the vessel and a structure that a vessel is moored to.

The term rock, sand, bottom, bottom material as used within the specification of the invention is intended to mean material found on the bottom of a body of water.

The prior art does not provide for an anchor that is light weight and is designed to hold a variety of bottom materials. The prior art includes the following marine anchor related patents: U.S. Pat. Nos. 3,651,777; 4,027,615; 5,154,133; 4,945,850; and US20160194058, which are incorporated by reference herein in their entirety.

The instant invention is lightweight and compact which makes it easy to carry and the reduced size makes it less bulky than traditional anchors which facilitates storage on a small boat.

The anchoring device of the instant invention is primarily an anchor having a box like shape and it provides a better deep-water anchor for watercraft. The instant invention provides the user the combination of compact design, reduced weight, and a strong holding power, easy of retrieval and the ability to grab instantly without the need for a heavy metal chain that is typically used with the current anchoring devices used with various watercraft.

The instant invention is foldable and uses at least one tines or teeth to dig into the bottom and/or grab onto rocks, roots, and other bottom debris. This allows the anchoring device of the instant invention to grab quickly in various types of bottoms without the need for a metal chain. More specifically the anchoring device of the instant invention is a triangle shaped, folding anchor with four tines in the back and 4 smaller tines in the front with a swiveling rod that helps the anchor dig in quickly in most bottom types and does not require the use of an anchor chain.

Referring now to FIG. 1-7 that show the various orthogonal and perspective views of the anchoring device 10 of the instant invention that is comprised of three sides that form an almost equilateral triangle when assembled. The slightly longer back side 15 contains 4 triangle shaped tines or teeth 20 and 30 (2 on each side) that dig into the bottom (sand, mud, clay) or grab onto various bottom structures or debris (rocks, roots) as the anchor device is being pull horizontally. The other two sides swivel 25 (attached to the back side) and have a smaller tines or teeth 30 (2 each) that are placed close to the front (the point where the two sides connect when assembled). The smaller tines or teeth 30 serve as the initial grabbing (digging) features that keep the front of the anchor device from being pulled upwards and reducing the overall travel length needed for the anchor to fully grab or dig in. The smaller size of the tines or teeth 30 (when compared to the larger back teeth) prevents the front from digging in too much before the larger back tines or teeth 20 get a chance to fully dig in. A metal rod 35 is attached to the swiveling hinge 40 in the front at a 90-degree angle and it only swivels left or right allowing it to be folded on top of the sides when the anchor is folded for storage. Metal rod 35 has fastening eye Because the metal rod 35 only has a 90-degree hinge connection that is perpendicular to the front of the anchor, the 90-degree hinge prevents the metal rod from moving up or down essentially adding vertical rigidity to the entire assembly and preventing the back of the anchor device from flipping over when the front tines or teeth 30 start to dig it. The swiveling metal rod 35 along with the smaller tines or teeth 30 and larger back tines or teeth 20 are the two key features that allow the anchoring device 10 of the instant invention to dig in quickly without the need for a chain. The swiveling metal rod 35 also provides leverage when the anchoring device is retrieved to dislodge the anchoring device 10 so that it can be easily retrieved when lodged in stoned, rocks or other materials that can be found on the bottom of a body of water.

One objective of the present invention is to help watercraft, boaters, fishermen and jet ski operators anchor their watercraft such that the anchor provides exceptional holding capability and is easy to retrieve when lodged in rock or debris on the bottom of the body of water.

Another objective is to provide a lightweight anchor that is easy to carry and store on marine vehicles.

Yet another objective is to provide an anchoring device 10 that is sufficiently compact for all kinds of watercraft, from small jet skis to large boats.

In some embodiments, the anchoring device 10 is fabricated, at least partially, from materials such as aircraft grade aluminum, steel, stainless steel and die cast aluminum. The configuration of the anchoring device 10 creates a lightweight anchor that is easy to carry on and off the vessel. This lightweight configuration is advantageous to prior art anchors that are bulky, long, and heavy, and are difficult to carry on and off the marine vehicle. However, since the device 10 is scalable, the weight may be greater or smaller depending on the configuration.

The anchoring device 10 has unique structural configurations that enhance the holding capacity.

The portable marine anchoring device can further be described as a portable marine anchoring device for use with a watercraft, the device comprising of:

a. at least three plates;
b. at least 2 tines attached to said at least three plates;
c. The at least three plates being hinged together so they form a geometric shape when the hinges are enabled so as the plates are attached together;
d. The at least three plates having a rod with a fastening eye 45 hinged to at least one of the at least three plates such that the fastening eye 45 is distal from the hinge;
e. said anchoring device being at least partially fabricated from a lightweight material; and
f. The fastening eye is connected to a tether and the tether connected to a vessel floating on a body of water.

In conclusion, a portable anchoring device 10 maximizes holding capacity while anchored on the bottom of the body of water and is easy to retrieve and store on the vessel.

Turning the attention to the instant invention is a portable and foldable fender for use with watercraft that provides a fender solution that is portable, lightweight and can be attached to a watercraft such that it cannot be dislodged from the vessel. The portable and foldable fender of the instant invention provides a combination of benefits to the users. The benefits include extended lateral protection, compact storage, adjustable bungee rope to secure the portable and foldable fender to the vessel, at least one secure hook to secure the portable and foldable fender to the vessel and an extended protection surface that forms the support for the fender. In a preferred embodiment the fender is wider at the bottom and narrow at the top to provide a centering mechanism for the fender thereby increasing the protection capabilities of the portable and foldable fender when deployed. However, the instant invention anticipates an extended protection surface that can be in any shape including but not limited to a square, oval, triangle, a polygon, a hexagon, or a pentagon and at least two pads position on the extended protection surface such it forms a self-aligning feature when positioned on the watercraft and between the watercraft and a piling or docking system.

The portable and foldable fender for a vessel can further be described as a foldable fender comprising:

a. an extended protection surface and the extended protection surface having a top surface, a back surface, and a bungee cord connector;
b. the extended protection top surface comprising of more than one pockets located on the top surface of the and extended protection surface and the pockets having a geometric shape;
c. at least one fender pillow located in each of the pockets,
d. the extended protection surface having a gap between the pockets and an interior space located between the pockets such that the gap between the pockets and the interior space forms a line formed comprised of the points corresponding to the gap between each the pockets and the interior space and the interior space forming at least one cavity such that when the extended protection surface is folded along the line one of the pockets and the interior space such that the pockets fits into the at least one cavity forming a compact the portable and foldable fender to facilitate for storage;
e. the portable and foldable fender comprising dual rail hooks that are attachable to the back surface of the extended protection surface and the dual rail hooks are removably attachable to a vessel to provide a secure connection of the portable and foldable fender to the vessel;
f. the portable and foldable fender comprising an adjustable bungee cord removably attached to the bungee cord connector; and
g. the bungee cord comprising a cord and the cord having a first end and a second end and the first end having a hook and the hook having a safety latch and the second end having a connection device such that the hook and the hook having a safety latch is removably connected to the connection device and the bungee cord is removably connected to the bungee cord connector and the hook having a safety latch prevents accidental decoupling when the bungee cord is attached to the bungee cord connector.

The portable and foldable fender for a vessel wherein the number of the pockets is selected from the group consisting of 2 pockets, 3 pockets, 4 pockets, 5 pockets, 6 pockets, 7 pockets, 8 pockets and 9 pockets.

The portable and foldable fender for a vessel wherein the at least one fender pillow is formed from material selected from the group consisting of foam, vinyl, and hollow vinyl tube.

The portable and foldable fender for a vessel wherein the geometric shape of the pocket is selected from the group consisting of a square, oval, triangle, a polygon, a hexagon, and a pentagon.

The portable and foldable fender for a vessel wherein the at least one fender pillow is formed sub pillows.

The portable and foldable fender for a vessel wherein the sub pillows is formed from the group consisting of 1 fender pillows, 2 fender pillows, 3 fender pillows and 4 fender pillows.

The portable and foldable fender for a vessel wherein the extended protection top is made from a material selected from the group consisting of canvas, duck, cotton duck, Kevlar®, PVC, aramid fiber, vinyl, silicone, polystyrene, polypropylene, plastic, plastic sheet, and plastic plates.

As shown in FIG. 8-17 there is shown a portable and foldable fender 100 for watercraft that maximizes protection area while minimizing storage requirements. The portable and foldable fender provides the following benefits to the user:

a. extended protection surface 105 for better protection with at least one fender pillow 135 and each at least one fender pillow 135 contained in pockets 110 located on said and extended protection surface 105 and said extended protection surface 105 having a surface top 106 and a surface back 108;

b. compact folding design 201 that is easier to store;

c. dual rail hooks 115 for a more secure connection to the vessel d. adjustable bungee cord 120 for universal compatibility.

e. hook with safety latch 130 to prevent accidental decoupling and loss.

The at least one fender pillow 135 when placed in pockets 110 forms a soft cushion and can be formed from any of the following materials but not limited to foam, vinyl, hollow vinyl tube and can assume a variety of geometric shape such as a cube, honeycomb shape, square, oval, triangle, a polygon, a hexagon, or a pentagon and can be fashioned from any soft or cushioned material.

The at least one fender pillow 135 can be attached to the extended protection surface 105 using pockets where the at least one fender pillow 135 is contained in the pocket 110. The one fender pillow 135 can be either removably or non-removably contained in pocket 110. The at least one fender pillow 135 and the pocket 110 can also be removably or non-removably attached to the attached to the extended protection surface 105 surface top 106 using a variety of methods including but not limited to Velcro® or hook and loop fasteners, snaps, clasps, sewn or attached with adhesive.

The extended protection surface 105 can be formed from any of the following materials but not limited to canvas, duck, cotton duck, Kevlar®, PVC, aramid fiber, vinyl, silicone, polystyrene, polypropylene, plastic, plastic sheet, plastic plates that can be hinged together utilizing plastic hinges, metal or plastic plates with hinges or any system that provides both flexibility and foldability.

The dual rail hooks 115 are designed so that they fit on the rub rail of the watercraft and provide a secure attachment of the lower portion of the extended protection surface 105. The instant invention also envisions that the dual rail hooks 115 can be 2 or more dual rail hooks 115 or a single hook depending on the type of watercraft used with the portable and foldable fender 100.

The portable and foldable fender 100 provides a protective cushion device that securely attaches to a watercraft such as a Jet Ski or other personal watercraft (PWC) before docking it and protects your watercraft from bumping and scratching against the dock or piling. The wider bottom of the portable and foldable fender 100 allows the portable and foldable fender 100 to "hug" a dock or piling and thereby significantly reducing the likelihood of the portable and foldable fender 100 being dislocated when subjected to wakes from other vessels and tidal movements.

The unique triangular shape of the portable and foldable fender 100 allows the fender to be folded when stowing it, thereby reducing the storage size requirement, allowing it to fit inside the watercraft storage compartment.

The adjustable bungee line allows for a secure connection on various watercraft or jet skis, regardless of their shape or connectivity options.

The portable and foldable fender for a vessel can be further described as a portable and foldable fender for a vessel comprising:

a. an adjustable bungee rope;

b. at least one hook to secure the portable and foldable fender to said vessel;

c. the portable and foldable fender being of triangular shape such that the portable and foldable fender is wider at the bottom and narrow at the top; and d. the portable and foldable fender having at least one cushion.

Figure 8:
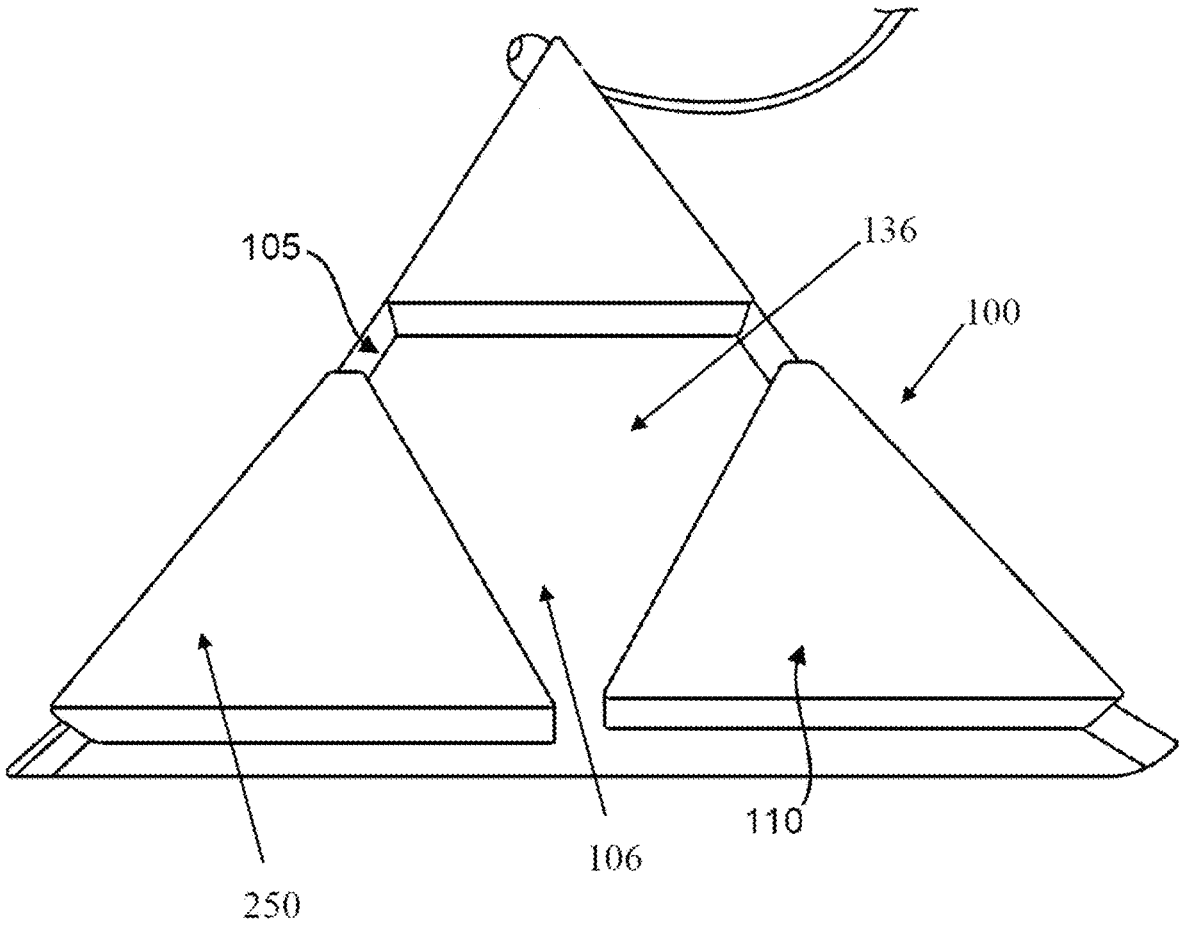
FIG. 8 is a folded view of the portable fender of the instant invention.
Figure 9:
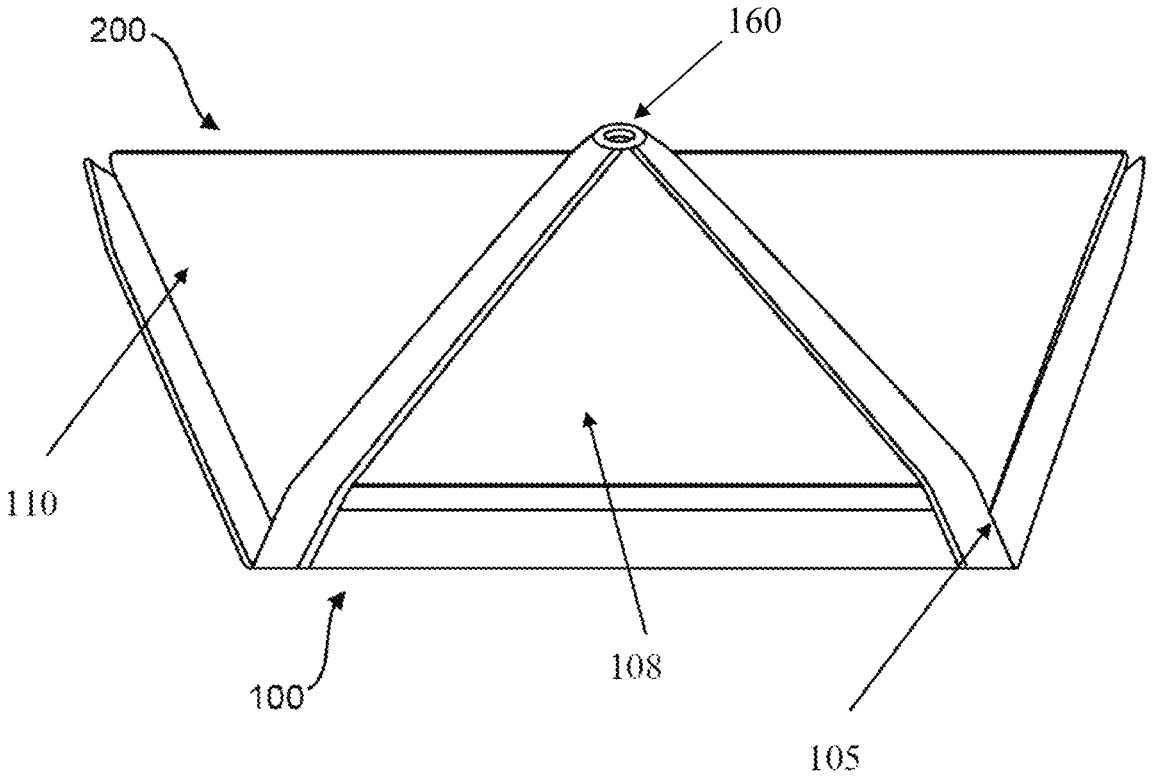
FIG. 9 is an unfolded front view of the portable fender of the instant invention.

Looking at the FIGS. 8-17 and more specifically FIG. 8 that shows an unfolded view of the portable fender 100 of the instant invention. The instant invention is comprised of an extended protection surface 105 that forms the support for the fender and at least two pads 135 (shown in FIG. 13) that fit into pockets 110 located on said and extended protection surface 105 having a surface top 106 and the at least two pads 135 when located in the pocket 110 form a cushioned surface 250. The extended protection surface 105 also has a surface back 108 (shown in FIG. 9). There is an interior space 136 that is located within the surface top 106 such that it is proximal to all the pockets 110 and located in such way that the pockets 110 form a part of the outer boundary of interior space 136 The pockets 110 are preferably oriented on extended protection surface 105 such that when folded as (shown in FIG. 9) the at least two pads 135 (shown in FIG. 13) that fit into a pockets 110 (shown in FIG. 14 and FIG. 8) located on said and extended protection surface 105 fit together so that the form a flat surface 200 (shown in FIG. 9) when folded in half for storage as shown in FIG. 9.

FIG. 9 is a folded front view of the portable fender of the instant invention. The portable fender 100 when folded provides a flat surface 200 and the at least two pads 135 (shown in FIG. 13) that fit into pockets 110 (shown in FIG. 14 and FIG. 8) located on extended protection surface 105 having surface back 108. The fit pockets 110 together so that they form a flat surface 200 when folded in half for storage. The pads 135 and associated pockets are designed so they are smaller in size than the interior space 136 of extended protection surface 105. The design can alternatively have different sizes of at least two pads 135 (shown in FIG. 13) that fit into pockets 110. In that case the pads 135 and pockets would be matched so that the appropriately sized at least two pads 135 fit in the appropriately sized pockets 110, thereby forming an at least two pads 135 fitting in different size pockets 110. Also, the design also envisions a different shaped at least two pads 135 and pockets 110, The at least two pads 135 can be shaped so they are any shape including but not limited to a square, oval, triangle, a polygon, a hexagon or a pentagon and the at least two pads 135 do not have to be all the same shape and that would necessitate that the pockets 110 would have matching shapes to hold the at least two pads 135. The extended protection surface 105 has a bungee cord connector 160.

Figure 10:
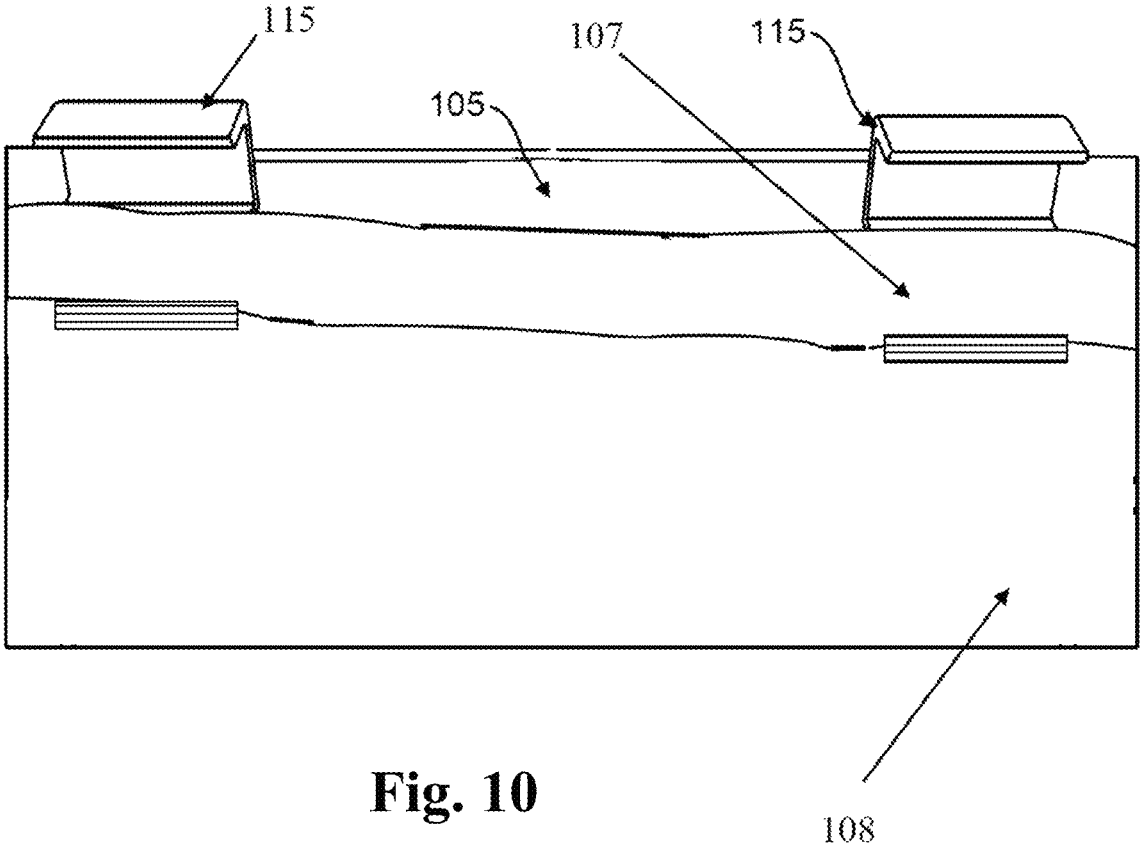
FIG. 10 is a back view of the portable fender of the instant invention showing the hooks.

FIG. 10 is a back view of the portable fender of the instant invention showing the dual rail hooks 115 attached to the extended protection surface 105 surface back 108. The dual rail hooks 115 can be attached to the extended protection surface 105 surface back 108 by inserting them into a pocket 107 or they can be attached to the extended protection surface 105 using a variety of methods including but not limited to Velcro® or hook and loop fasteners, snaps, clasps, sewn or attached with adhesive.

Figure 11:
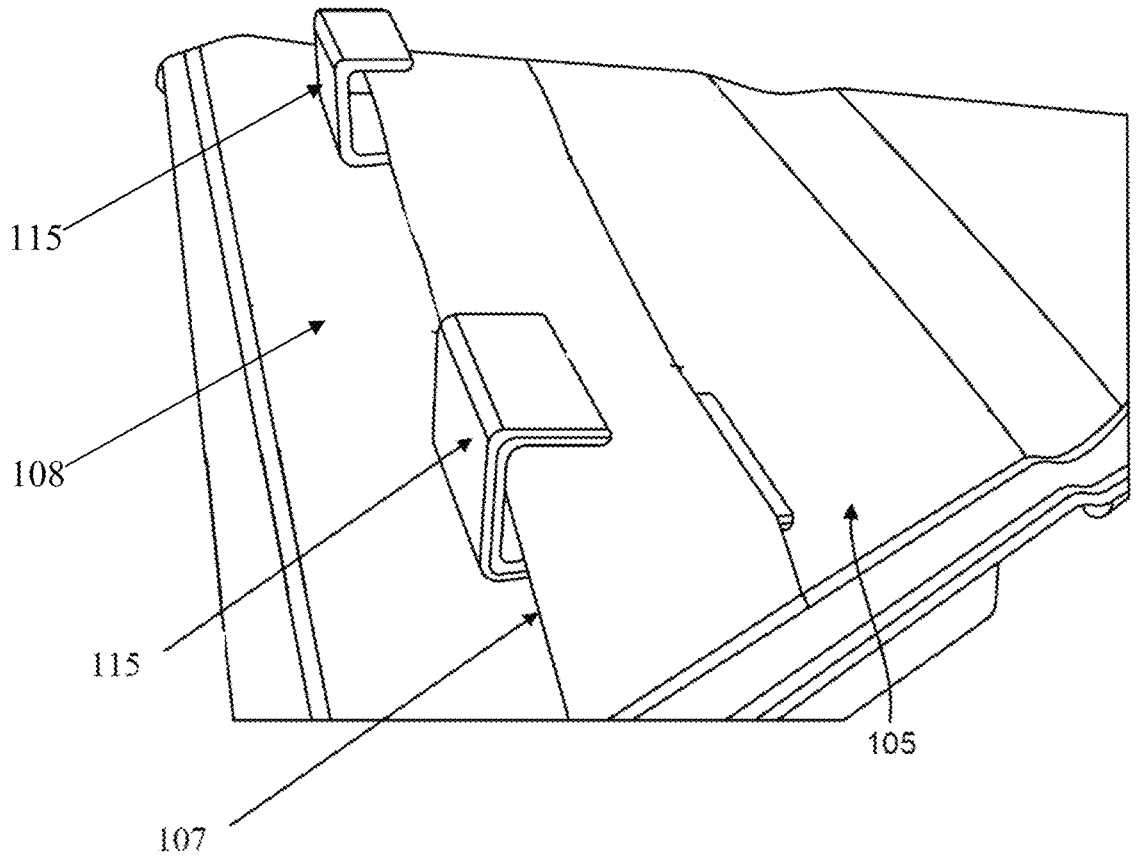
FIG. 11 is a lower back view of the portable fender of the instant invention showing the hooks.

FIG. 11 is a lower back view of the portable fender of the instant invention showing the extended protection surface 105 surface back 108, the dual rail hooks 115 in pocket 107.

Figure 12:
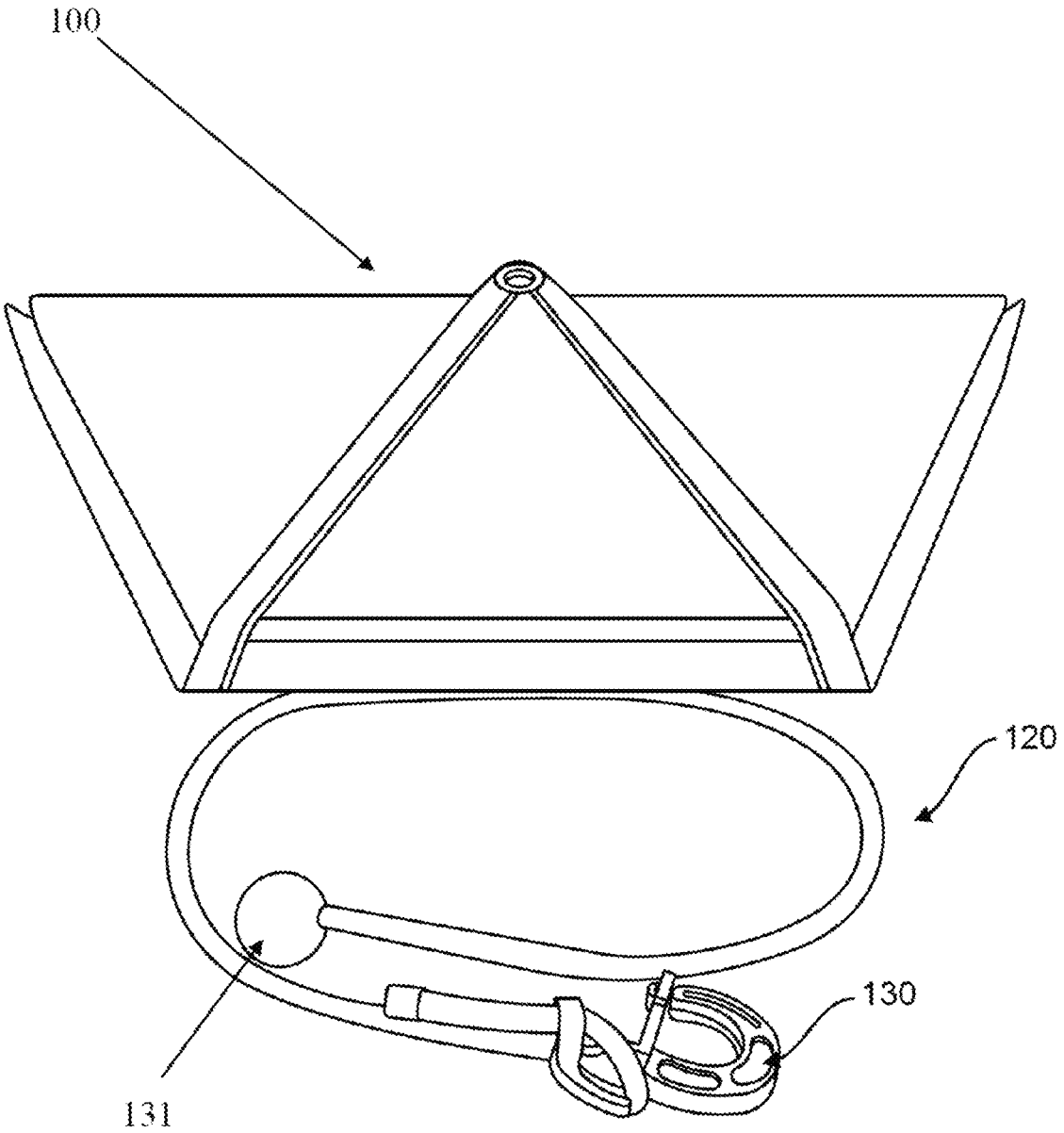
FIG. 12 is a folded view of the portable fender of the instant invention showing the Bungee Cord.

FIG. 12 is a folded view of the portable fender 100 of the instant invention showing the Bungee Cord 120 with hook 130. The opposite end of bungee cord 120 can have a bungee cord ball end 131 or a hook 130 depending on the configuration desired.

Figure 13:
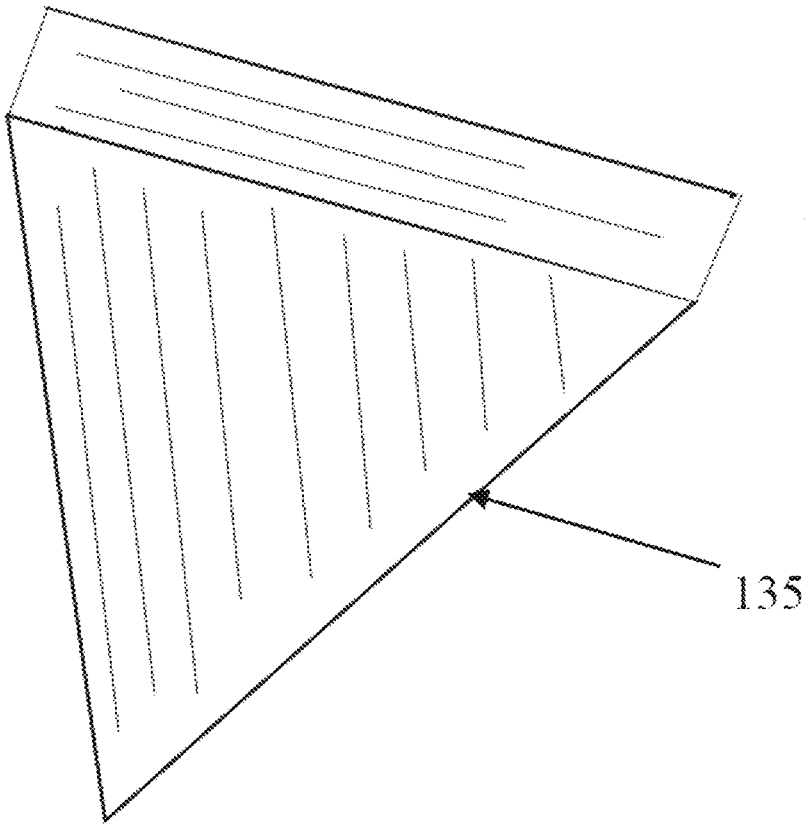
FIG. 13 shows a typical pad of the portable fender of the instant invention.

FIG. 13 shows a typical at least two pads 135 of the portable fender 100 (shown in FIG. 8) of the instant invention. The at least two pads 135 can be of any suitable shape such as and not limited to a square, oval, triangle, a polygon, a hexagon or a pentagon and the at least two pads 135 do not have to be all the same shape.

Figure 14:
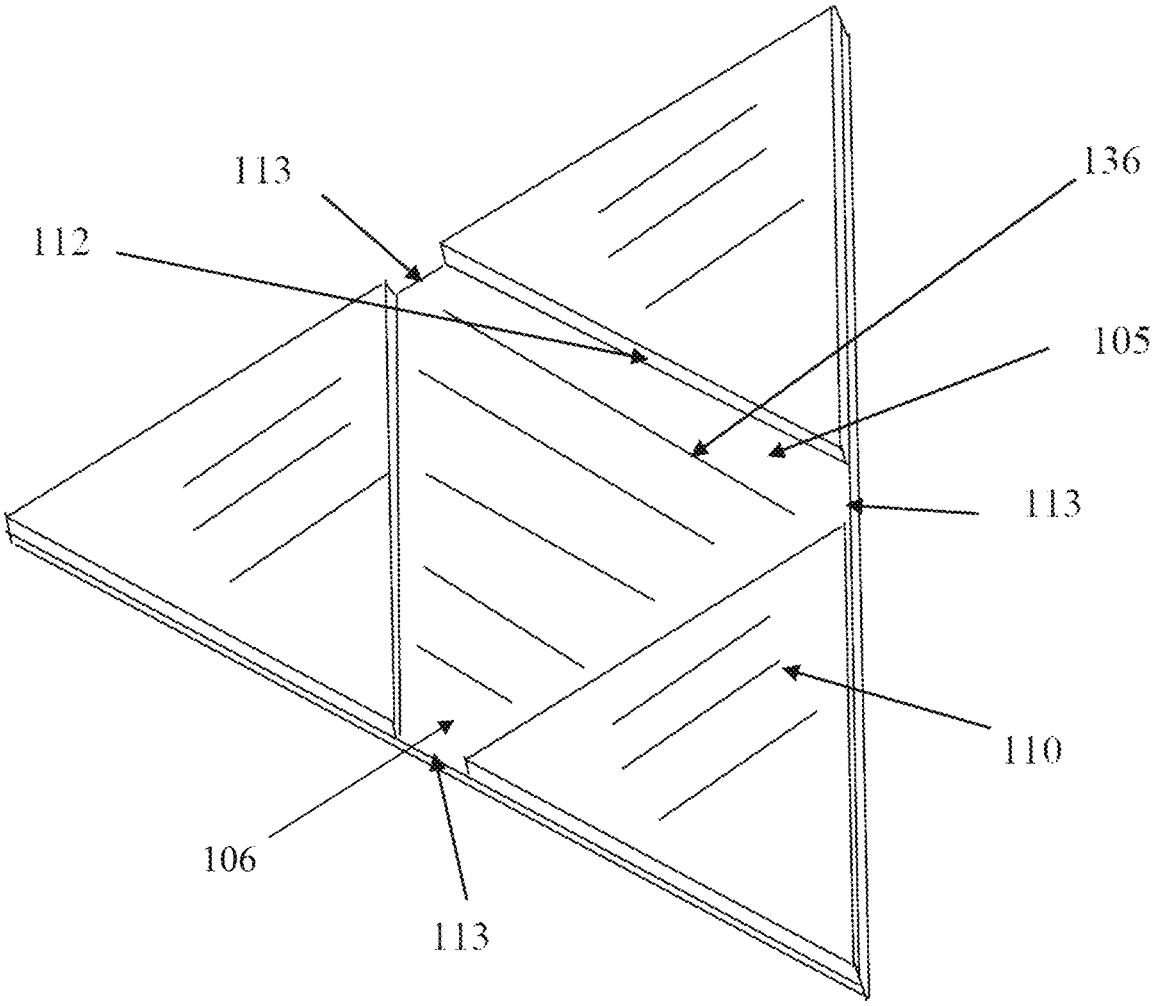
FIG. 14 shows a typical the extended protection surface with pockets.

FIG. 14 shows a typical extended protection surface 105 of the portable fender 100 of the instant invention having pockets 110. The pockets 110 on surface top 106 can be configured to either removably or non-removably hold the at least two pads 135 (shown in FIG. 13). The pockets 110 can be closed once the at least two pads 135 are installed and the pockets 110 can be sealed using a variety of methods including but not limited to Velcro® or hook and loop fasteners, buttons, snaps, clasps, sewn or attached with adhesive. The pockets 110 can have an extended tab 112 or flap that allows the pocket to be sealed similarly to a pocket closure using a button on a shirt pocket. The extended protection surface 105 has the gaps 113 and the interior space 136. These features allow the portable fender 100 to conform to a piling or dock rub rail. The gaps 113 and the interior space 136 allow the extended protection surface 105 the ability to flex and conform to the irregular surface of a piling or dock rub rail because the extended protection surface 105 is made from a flexible material or has the ability to flex. Typical materials for the extended protection surface 105 include but are not limited to canvas, duck, cotton duck, Kevlar®, PVC, aramid fiber, vinyl, silicone, polystyrene, polypropylene, plastic, plastic sheet, and plastic plates.

Figure 15:
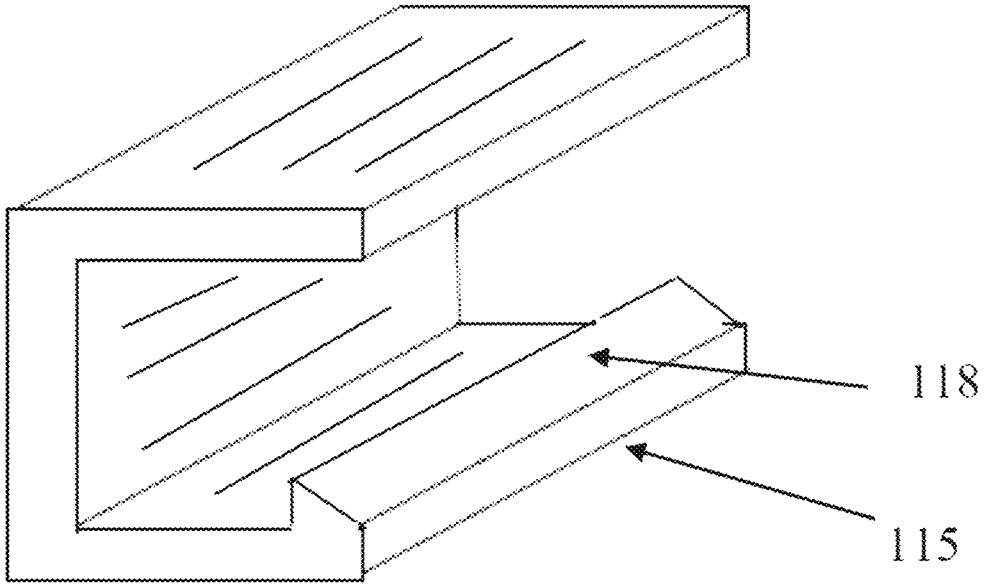
FIG. 15 shows a dual rail hook.

FIG. 15 shows a dual rail hook 115. The dual rail hook hooks 115 are preferably "U" shaped and one leg of the "U" shape is inserted into the pocket 107 of the extended protection surface 105 (shown in FIG. 11). Once inserted into the pocket 107 the leg of "U" shaped dual rail hook 115 inserted into the pocket 107 can have an optional retaining leg 118 used to can latch the dual rail hook 115 into the pocket 107. The dual rail hook 115 can also be attached using a latch, pin, or other fastening device to hold it to the pocket so that it is removable. If the user desires the hook 115 to be non-removeable then the hook 115 can be attached using a variety of methods including but not limited to Velcro® or hook and loop fasteners, buttons, snaps, clasps, sewn or attached with adhesive.

Figure 16:
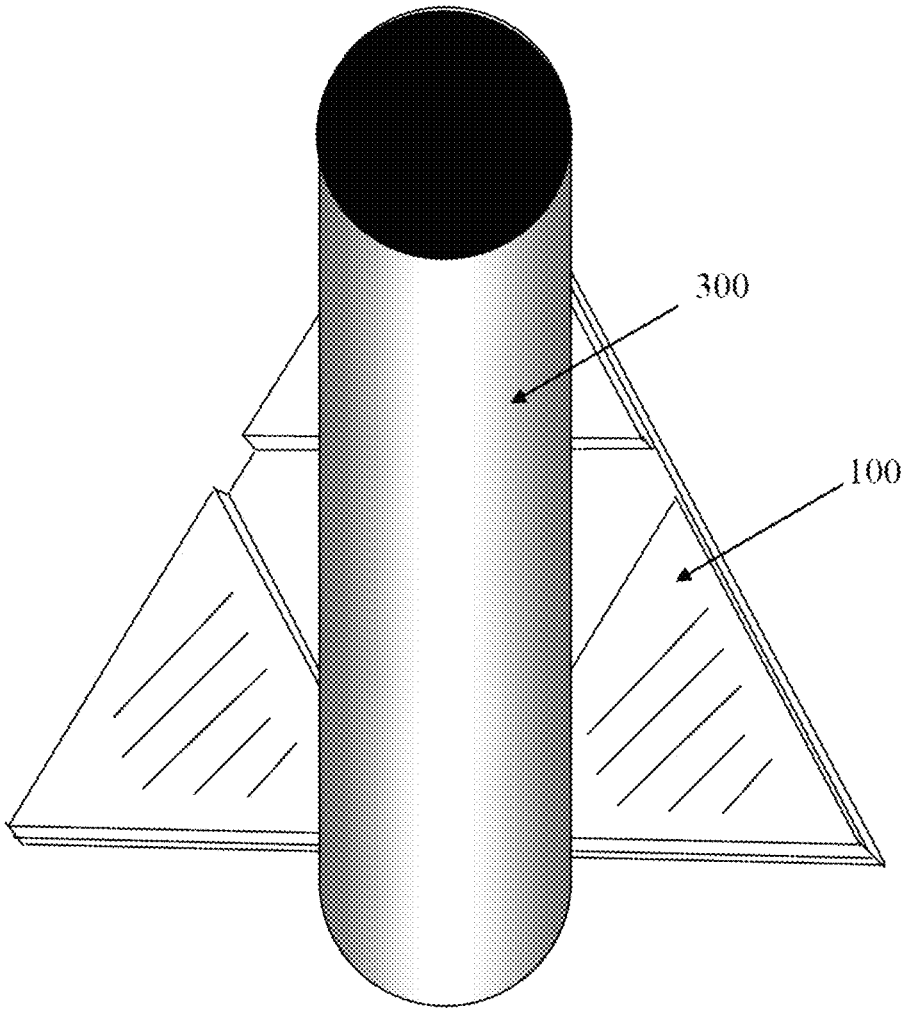
FIG. 16 shows a typical the extended protection surface with pockets when position on a piling.

Using FIG. 16 and FIG. 14, whereas FIG. 16 shows a typical installation where the portable fender 100 of the instant invention is positioned on a watercraft (not shown) and the portable fender 100 is placed between a piling 300 and the watercraft. The gaps 113 and the interior space 136 allow the extended protection surface 105 the ability to flex and conform to the irregular surface of a piling 300 and thereby grasp the piling 300 so that the portable fender 100 conforms to the piling 300. The instant invention thereby gets it protective and alignment capabilities from the extended protection surface 105 flexible material and the gaps 113 and the interior space 136 that allow the extended protection surface 105 the ability to flex and conform to the irregular surface of a piling or dock rub rail.

Figure 17:
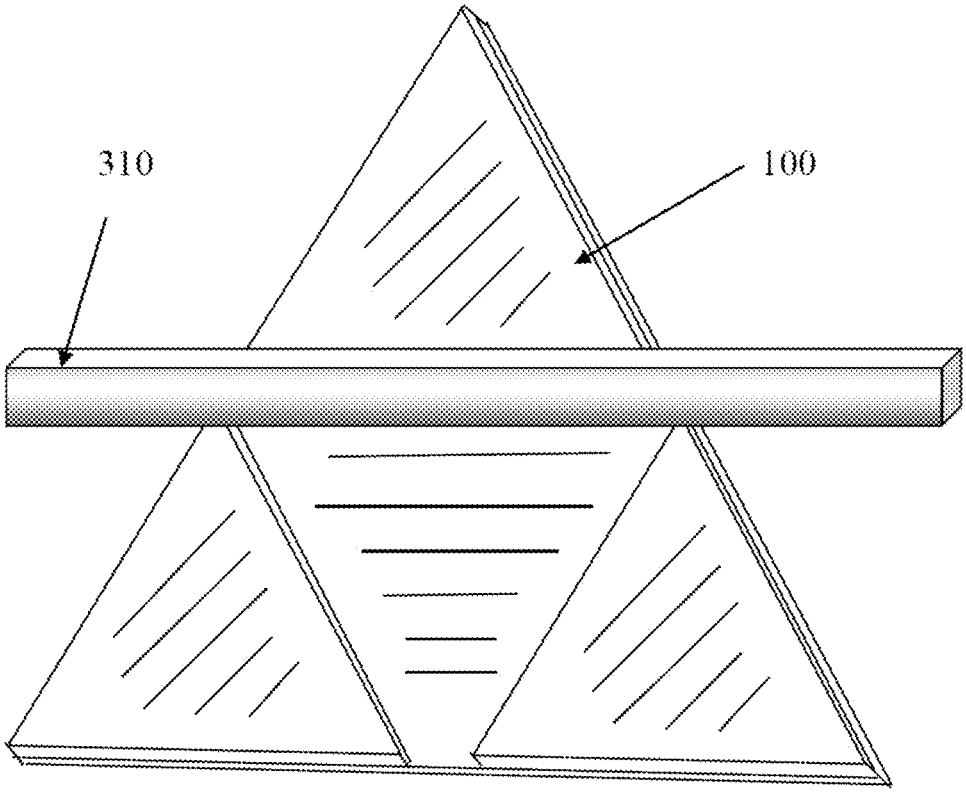
FIG. 17 shows a typical the extended protection surface with pockets when position on dock rub rail.

FIG. 17 and FIG. 14 whereas FIG. 17 shows a typical installation where the shows the portable fender 100 of the instant invention with respect to a typical installation where the portable fender 100 of the instant invention is positioned on a watercraft (not shown) and the portable fender 100 is placed between a dock having a dock rub rail 310. The gaps 113 and the interior space 136 allow the extended protection surface 105 the ability to flex and conform to the irregular surface of a dock rub rail 310 and thereby grasp the dock rub rail 310 so that the portable fender 100 conforms to the dock rub rail 310. The instant invention thereby gets it protective and alignment capabilities from the extended protection surface 105 flexible material and the gaps 113 and the interior space 136 that allow the extended protection surface 105 the ability to flex and conform to the irregular surface of a piling or dock rub rail.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

The present invention has been described with reference to embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

As far as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized that the scope of this invention is much broader than presented by the claim. It is intended that broader claims will be submitted in an application that claims the benefit of priority from this application.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A portable and foldable fender for a vessel comprising:

a. an extended protection surface and said extended protection surface having a surface top, a surface back, and a bungee cord connector;

b. said extended protection surface top comprising of more than one pockets located on said surface top of said and extended protection surface and said pockets having a geometric shape;

c. at least one fender pillow located in each of said pockets, d. said extended protection surface having a gap between said pockets and an interior space located between said pockets such that said gap between said pockets and said interior space forms a line formed comprised of the points corresponding to said gap between each said pockets and said interior space and said interior space forming at least one cavity such that when said extended protection surface is folded along said line one of said pockets and said interior space such that said pockets fits into said at least one cavity forming a compact said portable and foldable fender to facilitate for storage;

e. said portable and foldable fender comprising dual rail hooks that are attachable to said back surface of said extended protection surface and said dual rail hooks are removably attachable to a vessel to provide a secure connection of said portable and foldable fender to said vessel;

f. said portable and foldable fender comprising an adjustable bungee cord removably attached to said bungee cord connector; and g. said bungee cord comprising a cord and said cord having a first end and a second end and said first end having a hook and said hook having a safety latch and said second end having a connection device such that said hook and said hook having a safety latch is removably connected to said connection device and said bungee cord is removably connected to said bungee cord connector and said hook having a safety latch prevents accidental decoupling when said bungee cord is attached to said bungee cord connector.

2. A portable and foldable fender for a vessel of claim 1 wherein the number of said pockets is selected from the group consisting of 2 pockets, 3 pockets, 4 pockets, 5 pockets, 6 pockets, 7 pockets, 8 pockets and 9 pockets.

3. A portable and foldable fender for a vessel of claim 1 wherein said at least one fender pillow is formed from material selected from the group consisting of foam, vinyl and hollow vinyl tube.

4. A portable and foldable fender for a vessel of claim 1 wherein said geometric shape of said pocket is selected from the group consisting of a square, oval, triangle, a polygon, a hexagon and a pentagon.

5. A portable and foldable fender for a vessel of claim 1 wherein said at least one fender pillow is formed sub pillows.

6. A portable and foldable fender for a vessel of claim 5 wherein said sub pillows is formed from the group consisting of 1 fender pillows, 2 fender pillows, 3 fender pillows and 4 fender pillows.

7. A portable and foldable fender for a vessel of claim 1 wherein said extended protection top is made from a material selected from the group consisting of canvas, duck, cotton duck, PVC, aramid fiber, vinyl, silicone, polystyrene, polypropylene, plastic, plastic sheet and plastic plates.

* * * * *